US007815151B2

(12) United States Patent
Ruggiero et al.

(10) Patent No.: US 7,815,151 B2
(45) Date of Patent: Oct. 19, 2010

(54) METHOD AND SYSTEM FOR A TRACK SIGNALING SYSTEM WITHOUT INSULATED JOINTS

(75) Inventors: Andrew Lawrence Ruggiero, Lee's Summit, MO (US); Benjamin Paul Church, Blue Springs, MO (US); Jeffrey Michael Fries, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 751 days.

(21) Appl. No.: 11/626,489

(22) Filed: Jan. 24, 2007

(65) Prior Publication Data

US 2008/0173770 A1 Jul. 24, 2008

(51) Int. Cl.
*B61L 23/04* (2006.01)

(52) U.S. Cl. ..... 246/121

(58) Field of Classification Search ..... 246/167 R, 246/201, 202, 270 R, 20, 27, 120, 121
See application file for complete search history.

(56) References Cited

U.S. PATENT DOCUMENTS 4,065,081 A * 12/1977 Huffman et al. ..... 246/34 R
5,749,547 A * 5/1998 Young et al. ..... 246/4
6,779,761 B2 * 8/2004 Holgate ..... 246/34 R
6,830,224 B2 * 12/2004 Lewin et al. ..... 246/167 R
7,226,021 B1 * 6/2007 Anderson et al. ..... 246/121

FOREIGN PATENT DOCUMENTS

EP 0 049 607 4/1982
GB 1 412 243 10/1975

* cited by examiner

*Primary Examiner*—S. Joseph Morano
*Assistant Examiner*—Robert J McCarry, Jr.
(74) *Attorney, Agent, or Firm*—Robert Wawrzyn, Esq.; Terry M. Sanks, Esq.; Beusse Wolter Sanks Mora & Maire, P.A.

(57) ABSTRACT

In a railroad track system that provides for communications through a track rail without insulated joints between a specific transmitter and a specific receiver when a plurality of transmitters and a plurality of receivers are communicating using the track rail, a method including emitting a unique signal from the specific transmitter during a specific time. The unique signal is transmitted through a railway rail, which is without an insulated joint between successive rails and is the medium through which the unique signal travels, wherein the unique signal is detectable but not readable by the plurality of receiver. The specific receiver is activated to read the unique signal during the specific time.

17 Claims, 3 Drawing Sheets

METHOD AND SYSTEM FOR A TRACK SIGNALING SYSTEM WITHOUT INSULATED JOINTS

FIELD OF INVENTION

The field of invention relates to rail transportation and, more specifically, to a railway signaling system.

BACKGROUND OF THE INVENTION

Fixed rail transportation systems, that include one or more rail vehicles traveling over spaced apart rails of a railway track, have been an efficient way of moving cargo and people from one geographical location to another. In densely populated countries and countries having unimproved road transportation systems, rail vehicles may be the primary means for moving people and cargo. Additionally, rail transportation is used in areas where little to no population exists. Accordingly, there are probably millions of miles of railroad track throughout the world that need to be maintained.

There are over two hundred thousand wayside signaling devices deployed in association with railroad systems throughout the United States. Railroad systems include wayside equipment located along the track, such as switches, signals, and vehicle detectors. Wayside equipment may be defined as, for instance, a track-switch position device, a track occupancy detector, a wayside signaling device, a hot box detector, a hot wheel detector, a dragging equipment detector, a high water detector, a high/wide load detector, an automatic equipment identification system, a highway crossing system, an interlocking controller system, or any other equipment located adjacent the track and used to monitor the status of the track, environmental conditions, and/or railway vehicles. Various wayside equipment devices are located throughout the railroad system, and are thus geographically dispersed and often located at places that are difficult to access.

Railways generally employ wayside signals using color and position of these signals to convey movement authority information to the train crew. These signals are controlled locally by wayside signaling devices. Wayside signaling devices convey information between signal locations using the two rails of the railroad track as electrical conductors to form track circuits. Insulated rail joints are added at signal locations to allow separate track circuits to be formed between two signal locations. Currently, solid-state coded track circuits are used for railroad signaling. Such circuits are usually Direct Current (DC)-coded pulses that are used to convey information between signal locations. These wayside signaling devices rely on insulated rail joints at the wayside signal locations to prevent signals from promulgating to devices not intended to receive the signals.

FIG. 1 depicts a prior art exemplary embodiment of a solid state coded DC track system using insulated joint tracks. A railway track 9 has insulated joints 10 between where adjacent track rails 13 meet. The insulated joints 10 are used to form a block 11, 12 for railroad signaling. Signaling devices 14, 15 at first end of the block, 11, 12 transmits DC coded pulses that are detected and decoded by signaling devices 17, 18 at a second end of the block 11, 12. Depending on signaling devices, signaling, detection, and decoding signal transmission occurs in both directions of the block 11, 12, or in other words also from the second end to the first end. To insure that an intended signal is received, communication between signaling equipment 14, 17, 15, 18 is synchronized within a fixed code frame period. Therefore, the first signaling device 14, 15 within the respective box 11, 12 transmits during a first half of a period and the second signaling device 17, 18 transmits within a second half of the period. The insulated joints 10, retains the signal within a respective block and thus prevents the signal from emitting into another block 11, 12.

While most track components are viewed as being primarily mechanical in nature, many of them also serve an electrical purpose. Rails, ties, ballast, insulated joints, gauge plates, gauge rods and crossing panels in track locations where signals are transmitted through the rail must all have the correct electrical characteristics, as well as the right mechanical properties, in order for the signal equipment to function properly. This includes wayside signaling, cab signaling and crossing warning systems.

In the maintenance of railroad track, insulated joints can be a particular concern. As a mechanical discontinuity in the rails, the insulated joints must often endure a more severe "pounding" than the rails themselves are subjected to. Ballast and sub-grade materials can be affected, and significant "pumping" of the track may occur under heavy rail traffic. Despite all this, insulated joints must maintain a sound mechanical connection, and, ideally, maintain perfect electrical isolation.

In operation, the degree of electrical insulation provided by insulated joints may not be perfect, even when the insulated joints are. This is primarily due to ballast resistance providing an electrically-conductive path around each insulated joint. But every insulated joint's insulation eventually degrades. Thus, railroad owners and users would benefit from a railway where railway maintenance issues directly attributable to insulated railroad joints are reduced.

BRIEF DESCRIPTION OF THE INVENTION

Exemplary embodiments of the present invention are directed towards a system, method, and computer program code for promulgating recognizable signaling through a railway where insulated joints are not required. Towards this end, in an exemplary embodiment, in a railroad track system that provides for communications through a track rail without insulated joints between a specific transmitter and a specific receiver when a plurality of transmitters and a plurality of receivers are communicating using the track rail, a method is disclosed. The method includes emitting a unique signal from the specific transmitter during a specific time. The unique signal is transmitted through a railway rail, which is without an insulated joint between successive rails and is the medium through which the unique signal travels, wherein the unique signal is detectable but not readable by the plurality of receivers. The specific receiver is activated to read the unique signal during the specific time.

A railway track signaling system for communicating between wayside signal devices is also disclosed. The system includes a transmitter that emits a unique signal based on at least one of emitting the unique signal during a defined time, frequency modulating the unique signal, and phase modulating the unique signal. A railway track rail, proximate the transmitter, is also provided that is without an insulated joint between successive rails and is the medium through which the unique signal travels. A receiver is also disclosed being proximate the railway track rail to receive the unique signal based on being able to receive a signal during the defined time the unique signal is emitted, frequency de-modulating the unique signal, and/or phase de-modulating the unique signal.

In yet another embodiment, in a railroad track signaling system having a computer processor that provides for communications through a track rail without insulated joints between a specific transmitter and a specific receiver when a plurality of transmitters and a plurality of receivers are communicating using the track rail, a computer software code is provided. The computer software code includes a computer software module for emitting a unique signal from the specific transmitter during a specific time. The computer software code also has a computer software module for transmitting the unique signal through a railway rail wherein the unique signal is detectable but not readable by the plurality of receivers. A computer software module is also provided for activating the specific receiver to read the unique signal during the specific time.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAIL DESCRIPTION OF THE INVENTION

Figure 1:
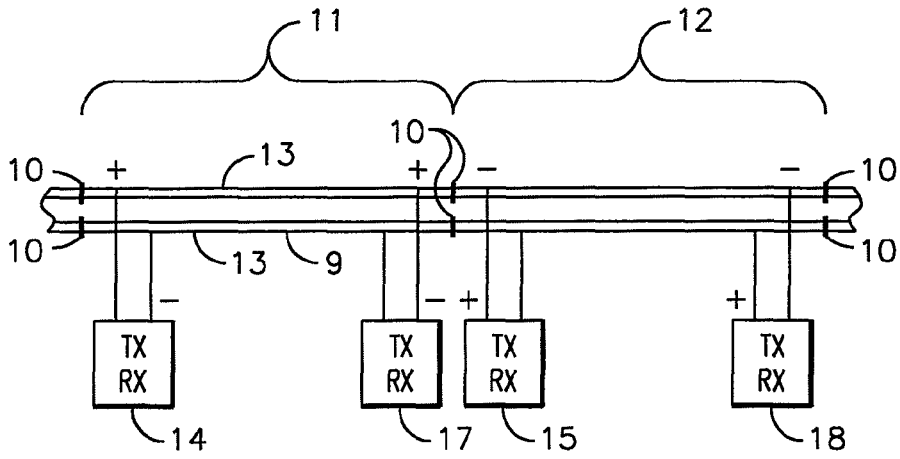
FIG. 1 PRIOR ART
FIG. 1 depicts a prior art exemplary embodiment of a solid state coded DC track system using insulated joint tracks.

Reference will now be made in detail to the embodiments consistent with the invention, examples of which are illustrated in the accompanying drawings. Wherever possible, the same reference numerals used throughout the drawings refer to the same or like parts. Though this invention is described with respect to railway systems, such as but not limited wayside signaling devices that communicate through a railway rail, those skilled in the art will readily recognize that the exemplary embodiments of the present invention may also be used for other systems, where signal information is sent from one location to another through a common carrier.

Exemplary embodiments of the present invention solves the problems in the art by providing a system, method, and computer software code, for a railway track signaling system to operate without needing insulated joints along a track rail. Persons skilled in the art will recognize that an apparatus, such as a data processing system, including a CPU, memory, I/O, program storage, a connecting bus, and other appropriate components, could be programmed or otherwise designed to facilitate the practice of the method of an exemplary embodiment of the invention. Such a system would include appropriate program means for executing the method.

Broadly speaking, the technical effect is operating a railway track signaling system without needing insulated joints along a track rail. An exemplary embodiment of the invention may be described in the general context of computer-executable instructions, such as program modules, being executed by a computer. Generally, program modules may include routines, programs, objects, components, data structures, etc., that perform particular tasks or implement particular abstract data types. For example, the software programs that underlie an exemplary embodiment of the invention can be coded in different languages, for use with different computing platforms. Examples of the invention may be implemented in the context of a web portal that employs a web browser. It will be appreciated, however, that the principles that underlie an exemplary embodiment of the invention can be implemented with other types of computer software technologies as well.

Moreover, those skilled in the art will appreciate that examples of the invention may be practiced with other computer system configurations, including hand-held devices, multiprocessor systems, microprocessor-based or programmable consumer electronics, minicomputers, mainframe computers, and the like. Examples of the invention may also be practiced in distributed computing environments where tasks are performed by remote processing devices that are linked through a communications network. In a distributed computing environment, program modules may be located in both local and remote computer storage media including memory storage devices.

Also, an article of manufacture, such as a pre-recorded disk or other similar computer program product, for use with a data processing system, could include a storage medium and program means recorded thereon for directing the data processing system to facilitate the practice of a method of an exemplary embodiment of the invention. Such apparatus and articles of manufacture also fall within the spirit and scope of the invention.

Referring now to the drawings, embodiments of the present invention will be described. The invention can be implemented in numerous ways, including as a system (including a computer processing system), a method (including a computer implemented method), an apparatus, a computer readable medium, a computer program product, a graphical user interface, including a web portal, or a data structure tangibly fixed in a computer readable memory. Several embodiments of the invention are discussed below.

Figure 2:
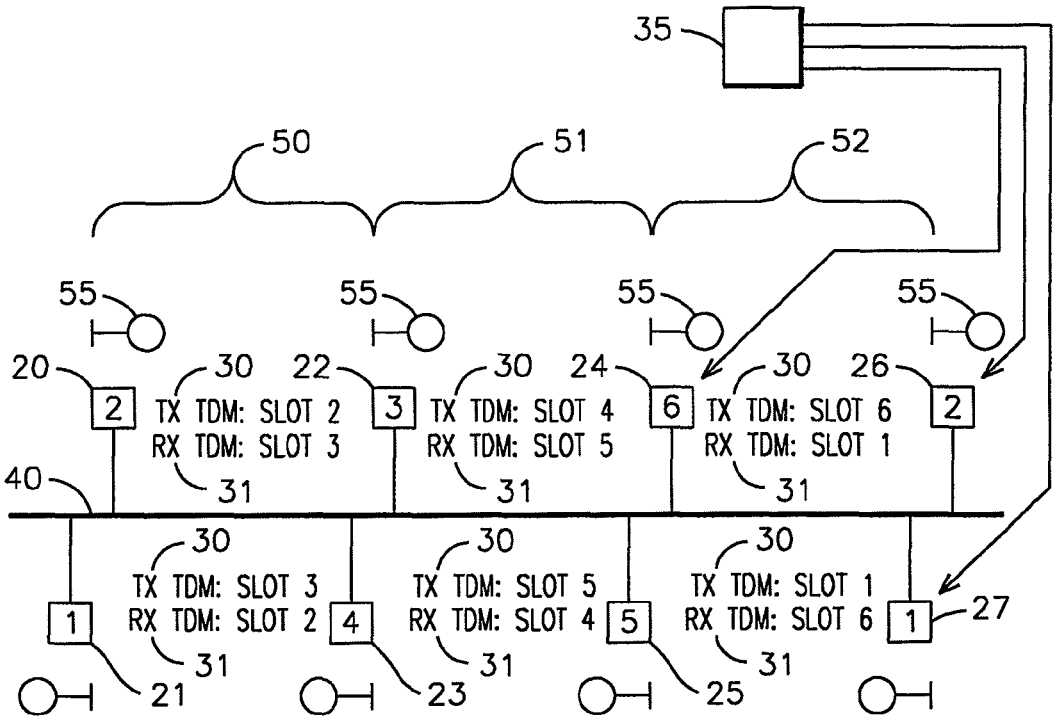
FIG. 2 depicts an exemplary embodiment of a signaling track system without insulated joints.

FIG. 2 depicts an exemplary embodiment of a signaling track system used in a railway track without insulated joints. As ones skilled in the art will recognize, an aspect of the invention may be implemented as a replacement for existing wayside signaling devices, upgrade of existing wayside signaling devices, and/or new wayside signaling devices that work in conjunction with existing wayside signaling devices. A form of time-division multiplexing (TDM) is used. TDM is a technique that allocates timeslots for each transmitting device to transmit over a shared medium to avoid contention.

A plurality of signaling devices 20, 21, 22, 23, 24, 25, 26, 27 are illustrated. In an exemplary embodiment each signaling device has a transmitter 30 and a receiver 31. Each transmitter 30 is synchronized to a common clock 35. Clock sources 35 may include, but are not limited to, a global positioning system (GPS) clock and/or broadcasting of time signals such as a WWV and/or a WWVB broadcast. The clock source 35 may be provided to each transmitter 30 through wireless communication and/or through wired communication.

Transmitters 30 within a range of common receivers 31 are assigned unique time slots for transmission. As illustrated, each transmitter 30 within ranges of common receivers 31 is assigned a time slot, such as but not limited to time slots 1 to 6. The time slots are sized to insure that adequate time for a signal to be transmitted without interfering with another signal being transmitted. Likewise, if a signal from a particular transmitter is suppose to reach a specific receiver at a specific time, each receiver is also assigned a unique time slot for receiving the transmission signal. As illustrated, suppose that a transmitter 30 associated with signaling device 27 is assigned time slot 1. The receiver 31 associated with signaling device 24 is also assigned time slot 1. Therefore when the clock source 35 is at a time for time slot 1, the transmitter 30 of signaling device 27 and receiver 31 of signaling device 24 are both turned on to transmit and receive, respectively. Exemplary embodiment of the invention as disclosed above allows for variation in the number of signals being sent along the line, or railway rail 40 and may also allow for constantly adjusting the time intervals to make optimum use of the available bandwidth. As further disclosed blocks 50, 51, 52 are illustrated in FIG. 2.

However wherein the blocks in FIG. 1 were defined by the insulated joints 10, the blocks in FIG. 2 are defined by location of wayside signals 55. Additionally, as illustrated in FIG. 1 signaling devices appear to repeat after a given distance. This occurs because the distance between such respective signaling devices are far enough apart that signals from these devices will not interfere with signals from the other respective devices. More specifically, a first signaling device 21 is far enough away from a second signaling device 27 such the transmitters 30 and receivers 31 or these signaling devices 21, 27 will not interfere with signals from the other signaling device 27, 21.

Figure 3:
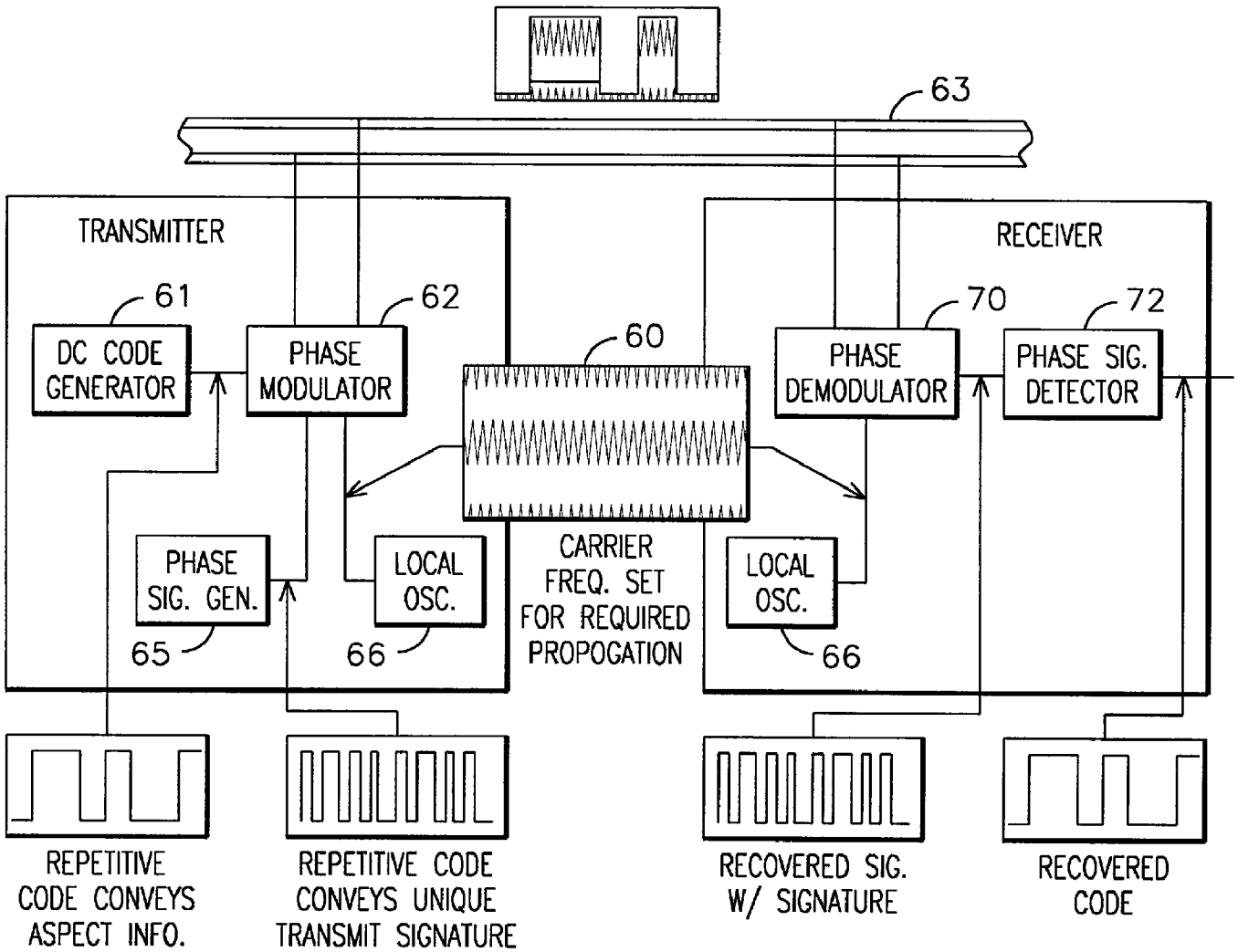
FIG. 3 depicts an exemplary embodiment of a transmit/receive block diagram used in a signaling track system without insulated joints.

An exemplary embodiment of the present invention further provides for modulation of signals using phase modulation. FIG. 3 depicts an exemplary embodiment of a transmit/receive block diagram used in a railway track signaling system without insulated joints between the rails. A carrier frequency 60 may be field adjustable, for example, so that it may be set to a low frequency sufficient to carry code information to its intended receiver at an opposite end of a block, even under changing ballast conditions, while limiting signal propagation to minimize interference at remote signaling devices.

To insure that receivers 31 do not decode signals from transmitters 30 other than the desired transmitters 30, unique phase signatures may be assigned each transmitter 30. The carrier frequency is phase modulated with a repeatable modulation signature that uniquely identifies the transmitter. The phase modulator may be configured to only pass DC codes that have matching phase signatures.

As illustrated, the transmitter 30 includes a code generator 61, such as but not limited to a DC code generator. The code generator 61 provides a repetitive code. A phase modulator 62 is also provided which is connected to the track 63. A phase signal generator 65 and local oscillator 66 are also provided. The phase signal generator 65 produces a repetitive code that conveys a unique transmitter signature. The transmitter 30 sends out a carrier frequency that is intended for a specific receiver 31.

The receiver 31 includes a phase de-modulator 70 that is attached to the track 63. A local oscillator 66 and phase signal detector 72 are attached to the phase-demodulator 70. The phase de-modulator 70 and phase signal detector 72 removes the repetitive code information provided resulting in the original signal.

By removing the insulated joints 10, the electrical separation between the track circuits is also removed. A small electrical boundary needs to be defined near the signal location to determine when the train has crossed that boundary. This resolution of train detection is required so that a signal is not downgraded in front of a moving train. A high frequency signal may be used to provide a short range train detection mechanism. The amplitude and/or frequency of this signal may be adjusted to get the desired resolution of train detection. In one aspect, a separate high frequency track circuit may be used as an overlay to provide this feature. In another embodiment, the high frequency signal may be imposed on top of the modulated signal described above. In another aspect, the high frequency signal may be created using intermodulation techniques of the modulated signal described above.

Exemplary embodiments of the invention insure that transmitters do not interfere with one another wherein each receiver decodes signals meant specifically for the respective receiver. This is accomplished using both a TDM technique described above which can be used in combination with frequency and phase modulation.

Figure 4:
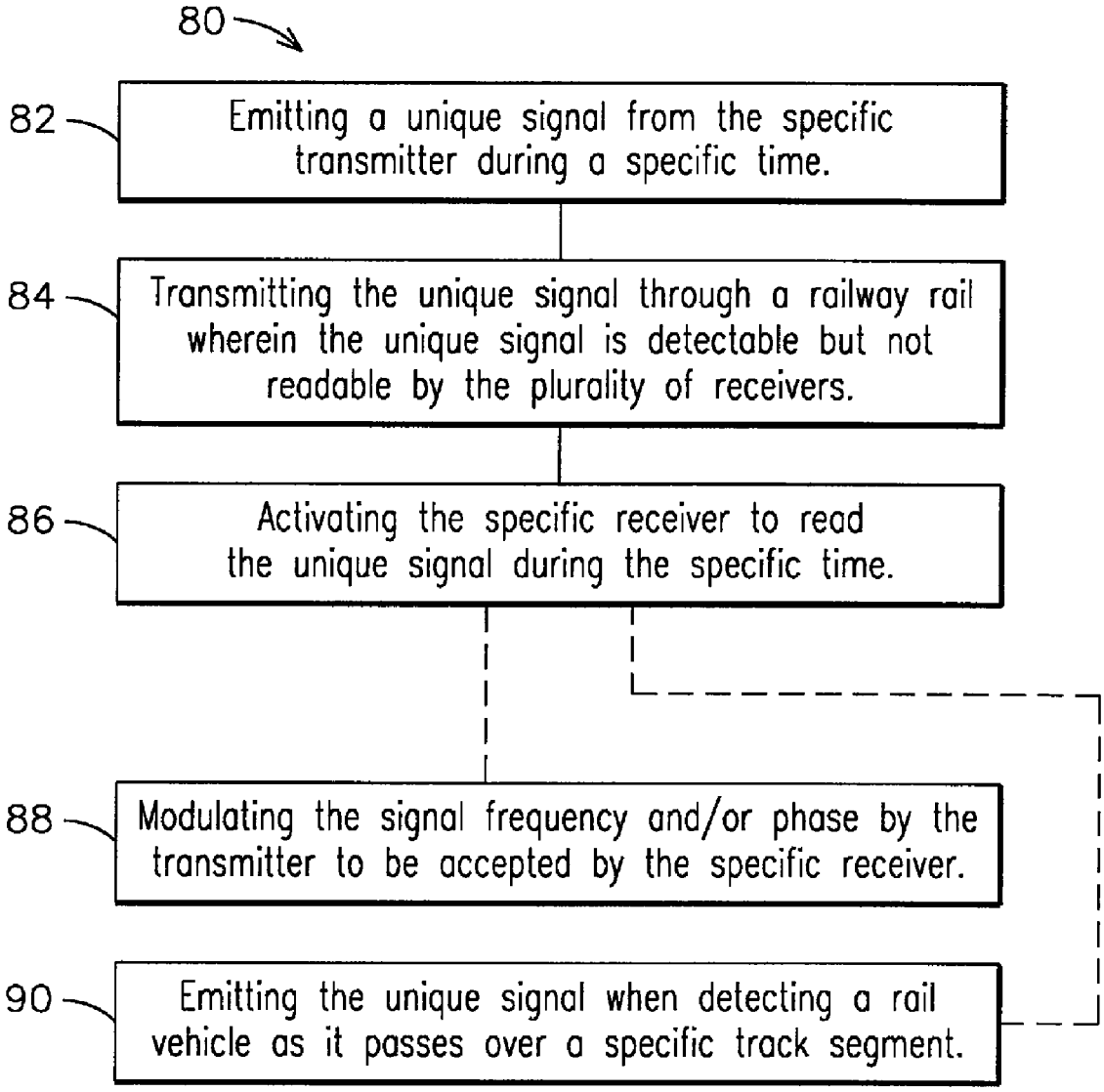
FIG. 4 depicts an exemplary embodiment of a flow chart of steps for a signaling track system that is used in a railway track system without insulated joints.

FIG. 4 depicts an exemplary embodiment of a flow chart of steps for a signaling track system that is used in a railway track system without insulated joints. As illustrated the flow chart 80 includes emitting a unique signal from a transmitter at a specific time, step 82. The signal is transmitted through a railway rail, step 84. A receiver, designated to receive the unique signal is activated to receive at the specific time, step 86. To further insure the correct signal is received by the receiver, the signal frequency and/or phase is modulated by the transmitter wherein the receiver is set to receive this specific frequency and/or phase modulated signal, step 88. If a signal needs to be transmitted as a rail vehicle passes over a certain track segment, the flow chart may further include detecting a rail vehicle on a certain segment prior to emitting the unique signal 90. For example, A high frequency signal may be used on a particular track segment to detect a rail vehicle at or near a signal boundary 90. To insure that the transmitter and receiver are operating at a correct time, each is synchronized to a common time. As disclosed above, the steps in the flow chart 80 may be implemented using a computer software code.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. In a railroad track system that provides for communications through a track rail without insulated joints between a specific transmitter and a specific receiver when a plurality of transmitters and a plurality of receivers are communicating using the track rail, a method comprising:

emitting a unique signal from the specific transmitter during a specific time, wherein during the specific time the other transmitters of the plurality of transmitters do not transmit signals through the track rail;

transmitting the unique signal through a railway rail, that is without an insulated joint between successive rails and is the medium through which the unique signal travels, wherein the unique signal is detectable but not readable by the plurality of receivers;

activating the specific receiver to read the unique signal during the specific time.

2. The method according to claim 1, wherein the unique signal further comprises at least one of frequency modulating and phase modulating the unique signal so that the specific receiver is able to read the unique signal while the unique signal is not readable by the other receivers of the plurality of receivers.

3. The method according to claim 1, wherein emitting the unique signal further comprises emitting the unique signal as a rail vehicle passes over a certain track segment.

4. The method according to claim 3, further comprises detecting the rail vehicles as it passes over the certain track segment with an audio frequency track circuit.

5. The method according to claim 1, wherein emitting the unique signal further comprises emitting the unique signal at a low frequency sufficient to carry code information in the unique signal to the receiver while limiting signal propagation to minimize interference of other receivers in the plurality of receivers.

6. In a railroad track system that provides for communications through a track rail without insulated joints between a specific transmitter and a specific receiver when a plurality of transmitters and a plurality of receivers are communicating using the track rail, a method comprising:

emitting a unique signal from the specific transmitter during a specific time;

transmitting the unique signal through a railway rail, that is without an insulated joint between successive rails and is the medium through which the unique signal travels, wherein the unique signal is detectable but not readable by the plurality of receivers;

activating the specific receiver to read the unique signal during the specific time; and synchronizing the transmitter and receiver to a same time.

7. The method according to claim 6, wherein the unique signal further comprises at least one of frequency modulating and phase modulating the unique signal so that the specific receiver is able to read the unique signal while the unique signal is not readable by the other receivers of the plurality of receivers.

8. The method according to claim 6, wherein emitting the unique signal further comprises emitting the unique signal as a rail vehicle passes over a certain track segment.

9. The method according to claim 8, further comprises detecting the rail vehicles as it passes over the certain track segment with an audio frequency track circuit.

10. The method according to claim 6, wherein emitting the unique signal further comprises emitting the unique signal at a low frequency sufficient to carry code information in the unique signal to the receiver while limiting signal propagation to minimize interference of other receivers in the plurality of receivers.

11. A railway track signaling system for communicating between wayside signal devices, the system comprises:

a transmitter that emits a unique signal based on at least one of emitting the unique signal during a defined time, frequency modulating the unique signal, and phase modulating the unique signal;

a railway track rail, proximate the transmitter, that is without an insulated joint between successive rails and is the medium through which the unique signal travels;

a first receiver, that is part of a plurality of receivers, proximate the railway track rail to receive the unique signal based on being able to receive at least one of a signal during the defined time the unique signal is emitted, frequency de-modulating the unique signal, and phase de-modulating the unique signal; and a clock source to synchronize operating time of the transmitter and the receiver;

wherein all other receivers that are part of the plurality of receivers are unable to read the unique signal.

12. The system according to claim 11, further comprises a signaling device that has at least a transmitter and a receiver.

13. The system according to claim 11, wherein the transmitter comprises at least one of a code generator, a phase modulator, a phase signal generator, and a local oscillator, used to create the unique signal.

14. The system according to claim 11, wherein the first receiver comprises at least one of a phase de-modulator, a local oscillator, and a phase signal detector, used to read the unique signal.

15. The system according to claim 11, further comprises a detector to determine when a rail vehicles passes over a specific track segment.

16. A railway track signaling system for communicating between wayside signal devices, the system comprises:

a transmitter that emits a unique signal based on at least one of emitting the unique signal during a defined time, frequency modulating the unique signal, and phase modulating the unique signal;

a railway track rail, proximate the transmitter, that is without an insulated joint between successive rails and is the medium through which the unique signal travels; and a first receiver, that is part of a plurality of receivers, proximate the railway track rail to receive the unique signal based on being able to receive at least one of a signal during the defined time the unique signal is emitted, frequency de-modulating the unique signal, and phase de-modulating the unique signal;

wherein all other receivers that are part of the plurality of receivers are unable to read the unique signal and wherein the detector comprises an audio frequency track circuit.

17. A railway track signaling system for communicating between wayside signal devices, the system comprises:

a transmitter that emits a unique signal based on at least one of emitting the unique signal during a defined time, frequency modulating the unique signal, and phase modulating the unique signal;

a railway track rail, proximate the transmitter, that is without an insulated joint between successive rails and is the medium through which the unique signal travels; and a first receiver, that is part of a plurality of receivers, proximate the railway track rail to receive the unique signal based on being able to receive at least one of a signal during the defined time the unique signal is emitted, frequency de-modulating the unique signal, and phase de-modulating the unique signal;

wherein all other receivers that are part of the plurality of receivers are unable to read the unique signal; and wherein the audio frequency track circuit has a frequency that is adjustable for a specific detection distance.

* * * * *